US007601306B2

(12) United States Patent
Sakurai

(10) Patent No.: US 7,601,306 B2
(45) Date of Patent: Oct. 13, 2009

(54) DIESEL ENGINE PARTICULATE FILTER

(75) Inventor: Shinichiro Sakurai, Tokyo (JP)

(73) Assignee: Lenz Environmental Resources Co., Ltd. (JP)

( * ) Notice: Subject to any disclaimer, the term of this patent is extended or adjusted under 35 U.S.C. 154(b) by 647 days.

(21) Appl. No.: 10/397,175

(22) Filed: Mar. 27, 2003

(65) Prior Publication Data

US 2003/0185719 A1 Oct. 2, 2003

(30) Foreign Application Priority Data

Mar. 29, 2002 (JP) ..... 2002-093781

(51) Int. Cl.
*B01D 53/34* (2006.01)

(52) U.S. Cl. ..... 422/168; 422/177; 422/180; 422/174; 422/175; 422/178; 422/171; 422/218; 422/181; 422/192; 55/523; 55/524; 55/527

(58) Field of Classification Search ..... 422/179, 422/177, 168, 181, 218, 192; 55/523–524, 55/527

See application file for complete search history.

(56) References Cited

U.S. PATENT DOCUMENTS

| | | | | |
|---|---|---|---|---|
| 3,449,086 A * | 6/1969 | Innes | 422/181 |
| 3,874,854 A * | 4/1975 | Hunter, Jr. | 422/175 |
| 3,959,183 A | 5/1976 | Gospodar | |
| 4,148,860 A | 4/1979 | Goedicke | |
| 5,100,632 A | 3/1992 | Dettling et al. | |
| 5,466,651 A | 11/1995 | Pfefferle | |
| 5,665,322 A | 9/1997 | Kiyohide et al. | |
| 5,948,355 A * | 9/1999 | Fujishima et al. | 422/4 |
| 6,077,600 A * | 6/2000 | Atmur et al. | 428/293.4 |
| 6,248,689 B1 | 6/2001 | Manson | |
| 6,585,788 B2 * | 7/2003 | Sugano | 55/282.3 |

FOREIGN PATENT DOCUMENTS

| | | |
|---|---|---|
| EP | 0 387 394 | 8/1989 |
| EP | 1 348 839 | 10/2003 |
| JP | 06-323129 | 11/1994 |
| JP | 09-125931 | 5/1997 |
| JP | 2000-230887 | 8/2000 |
| WO | WO 99/33549 | 7/1999 |

OTHER PUBLICATIONS

Notice of Allowance in JP2002-093781, dated Aug. 31, 2007 (English translation).

* cited by examiner

*Primary Examiner*—Alexa D. Neckel
*Assistant Examiner*—Kaity V. Handal
(74) *Attorney, Agent, or Firm*—Blank Rome LLP

(57) ABSTRACT

A diesel engine particulate filter (DPF) comprising a case cylinder with a filter space formed by the inner retention cylinder and outer retention cylinder which traverse the radial symmetry of the case cylinder. In filter space, the low temperature exothermic catalyst granules group component of precious metals, such as platinum, coexist with a mixture of medium temperature exothermic catalyst carried by granules group filter of foaming stone grains made of base metals, such as nickel and cobalt. Exhaust flow travels from the inner space of the inner side retention cylinder to the filter space where particulate matter (PM) is trapped. PM burned by the medium temperature exothermic catalyst functions by the rise in exhaust temperature obtained from the low temperature exothermic catalyst where hydrocarbon (HC) is burned. As a result, a DPF (1) that burns PM even when the exhaust temperature is low can be realized, without using an electric heater.

13 Claims, 3 Drawing Sheets

DIESEL ENGINE PARTICULATE FILTER

BACKGROUND OF THE INVENTION

1. Field of the Invention

The present invention relates to a diesel engine particulate filter (DPF) designed to physically trap particulate matter (PM) contained in diesel engine exhaust gases and particularly to a DPF in which heating and combustion of the PM are possible.

2. Description of the Related Art

The principal component in diesel engine exhaust gases is typically defined as solid type particulate matter (PM) made of inorganic carbon, also referred to as diesel soot.

Due to the acute and chronic effects on public health, carbon and other particulate substances should not be emitted into the atmosphere, thereby contributing to the level of man-made air pollution.

In view of the foregoing, a diesel engine particulate filter (DPF) integrated with the diesel engine's exhaust system is needed to trap emitted PM in the filter part and incinerate the particulates.

As an example of such a conventional DPF, Asakura Publishing Company, Ltd. printed a book dated Jul. 10, 1997 by the Society of Automotive Engineers of Japan, Inc., titled "Automobile Technical Series" (Volume 1), which contained an editorial "Automobile Motor Technology Corresponding to the Environment" on pages 139-148.

Another description was published by Sankaido Incorporated in their Jan. 10, 1994 issue, which contained an article written by Naoya Miyashita and Hideo Kuroki titled "The Diesel Engine for Cars" on pages 53-54.

Under normal operating conditions to burn PM trapped in the filter part of the DPF, it is necessary to heat PM to the reaction temperature of at least 550 degrees centigrade (1,022 degrees Fahrenheit), which is about the established spontaneous combustion temperature of PM.

For this reason, there are numerous conventional DPF which provide an electric heater to generate heat in the DPF.

In addition, there are other various adopted combustion systems. There are assorted DPF which burn carbon that is the principal component of PM at temperatures of 250 degrees centigrade or more. For instance, silicon dioxide, manganese oxide, and aluminum oxide powder mixed and sintered catalysts are used as an oxidation catalyst carried in the aluminum oxide coating with high dispersed platinum. These different methods facilitate regeneration ("burning off" process) and capture nitrogen dioxide ($NO_2$) in the exhaust. This $NO_2$ is used as a catalyst for PM combustion.

However, in the above-mentioned DPF using a conventional electric heater, while it is possible to ignite PM according to the condition of the filter part, a significant amount of electrical power is consumed to generate heat above 550 degrees centigrade. Furthermore, it is very difficult to continuously maintain the aforementioned temperature with the battery loading of usual vehicles.

Accordingly, although such an electric heater system is suitable for instance in a forklift which operates within the confines of a factory and the battery recharged while inactive from a 200V power supply on the premises, it is unsuitable for vehicles similar to a regular transportation truck outside the premises and not accessible to an external power source.

On the contrary, the above-mentioned DPF using the conventional $NO_2$ as a catalyst, an electric heater is not necessary as it is possible to burn PM exhaust at the temperature of about 250-300 degrees centigrade or lower than using an electric heater. However, exhaust temperature will vary in the DPF during driving time. For example, exhaust temperature while driving in ordinary urban districts on average will reach 200 degrees centigrade or less; whereas, traveling on the highway slightly exceeds 250 degrees centigrade at least part of the time.

Consequently, even during short runs operating at high speed, driving conditions almost never reach the exhaust temperature needed to completely burn the trapped PM. Moreover, since $NO_2$ is generated and used as a catalyst, it is not desirable to emit this gaseous pollutant into the atmosphere.

Using ammonia for reducing $NO_2$ has also been proposed. In ground equipment, such as a factory, this solution may be satisfactory. However, this method is not feasibly adaptable for ammonia to be carried in vehicles, due to vibration problems typical of diesel exhaust systems and create the risk of a collision with another vehicle or object.

The main reasons why the above-mentioned diesel engine exhaust measures have not progressed compared to gasoline engine exhaust measures is explained below.

In the case of diesel engines, (1) gasoline engines use an air-fuel ratio controlled before and after the ideal combustion ratio of gasoline and air, which is in direct contrast with diesel engines that use light oil for fuel and air is invariably overwhelmingly superfluous; (2) catalysis between solid matter catalyst and other types of substances make it react. Since a large part of the reaction occurs within the pores of a solid matter catalyst, other types have to be in the form of gas or liquid to improve combustion. When compared to the case of diesel engines, the exhaust component is different than gasoline engines in that the exhaust includes a greater amount of solid matter PM that sticks to one another, thereby making it difficult for PM to enter the pores of a solid matter catalyst. Also, the properties and origin of the soot affect its ability to be oxidized. These are the main reasons why exhaust measures have not progressed more rapidly.

In fact, in an experiment by this inventor, to serve as a filter to trap PM, foaming stone grains were formed with a large number of pores with only an adhered coating of base metals as the oxidation catalyst, such as nickel, cobalt, etc. PM burned at about 400 degrees centigrade, which is slightly lower than its spontaneous combustion temperature. However, it didn't reach the temperature that exhaust reaches in the DPF while driving, and likewise combustion of carbon monoxide (CO) and hydrocarbon (HC) hardly progressed.

On the other hand, in another experiment performed with only platinum as the precious metals catalyst, it adhered to the aluminum oxide ($Al_2O_3$) carrier intermingled with the foaming stone grains. Even though combustion of CO and HC advanced, the PM did not burn but was accumulated on the filter part.

The purpose of this invention is to provide a diesel particulate filter which enables removal of harmful particulate matter (PM) from the exhaust discharged from a diesel engine and incineration of the PM at the lowest possible emission temperature in a diesel engine particulate filter (DPF), without the use of an electric heater.

SUMMARY OF THE INVENTION

To attain the above-mentioned purpose in the preferred mode, a diesel engine particulate filter (DPF) of the invention includes a case cylinder, a filter, an exothermic catalyst, and a retention structure. The case cylinder is connected to a diesel engine via an exhaust pipe having an exhaust stream entrance part and an exhaust stream exit part. The filter is arranged inside the case cylinder for circulating discharged exhaust from the diesel engine and trapping particulate matter in the exhaust. The exothermic catalyst has a low temperature exothermic catalyst of precious metal and a medium temperature exothermic catalyst of a base metal in a state of mixed dispersion thereof on the filter. The retention structure retains the exothermic catalyst and the filter in the case cylinder. The retention structure includes an inner retention cylinder and a star-shaped outer retention cylinder. The inner retention cylinder extends along an axis direction of the case cylinder and forms at last one communicative connection passageway enabling outflow of exhaust radially outward. The star-shaped outer retention cylinder has alternately a plurality of mountain-shaped parts and a plurality of valley-shaped parts, where the star-shaped outer retention cylinder is arranged radially outward of said inner retention cylinder and it is formed with micro-spaces to flow the exhaust from an inside thereof to an outside thereof. The inner side and the outer side of the star-shaped outer retention cylinder is formed shaped like a star and sandwiches a fiber for further trapping residual particulate matter passing through the filter. The filter with the exothermic catalyst is arranged between the inner retention cylinder and the star-shaped outer retention cylinder. The low and medium temperature exothermic catalyst coexists on the filter shaped like a star corresponding to the star-shaped outer retention cylinder, being urged toward the inner retention cylinder by elastic force of the fiber of the outer retention cylinder.

A low temperature exothermic catalyst of precious metals, for example platinum, and a medium temperature exothermic catalyst of base metals are used, such as nickel and cobalt.

The DPF in the above-mentioned structure, is described hereafter. The DPF comprises a case cylinder, an inner retention cylinder forms the communicative connection passageways to facilitate outflow of the exhaust radially outward and extends along the axis of the case cylinder; arranged radially outward of the inner retention cylinder, an outer retention cylinder forms the communicative connection passageways to facilitate outflow of the exhaust radially outward; an inflow side support member supports each inflow side end of the inner retention cylinder and the outer retention cylinder in a case cylinder; and an outflow side support member supports each outflow side end of the inner retention cylinder and the outer retention cylinder in the case cylinder. The DPF further comprises the inflow side support member that consists of a plugged part located from the perimeter of the inner retention cylinder to the inner circumference portion of the case cylinder which prevents the inflow of exhaust; an inflow side communicative connection communicates with the inner space of the inner retention cylinder, and an exhaust stream entrance part permits inflow of exhaust from the exhaust stream entrance part to the inner space of the inner retention cylinder; an outflow side exhaust plugged part which an outflow side support member prevents the outflow of exhaust to the exhaust stream exit part from the inner space of the perimeter of at least the inner retention cylinder; outflow side communicative connection passageways which communicate with at least the outer space and the exhaust stream exit part formed between the outer retention cylinder and the case cylinder into the segment from the perimeter segment of the outer retention cylinder and the inner circumference portion of the case cylinder, and thereby characterizes the present invention to hold a filter and catalyst in a filter space formed between the inner retention cylinder and the outer retention cylinder.

The DPF is characterized by the feature of the above-mentioned low-temperature exothermic catalyst and the medium exothermic catalyst, which are intermingled in the above-mentioned filter as a granules group to make at least one of the exothermic catalyst adhere to the carrier surface substance.

For example, ceramic based substances are used as a carrier, such as aluminum oxide ($Al_2O_3$).

The DPF is characterized by the above-mentioned low temperature exothermic catalyst and the medium temperature exothermic catalyst configured by making at least one exothermic catalyst adhere to the filter and another exothermic catalyst arranged around a granules group which adhere to the carrier.

The DPF is characterized by the exothermic catalyst of the above-mentioned granules group being a low-temperature exothermic catalyst.

The DPF is characterized by the above-mentioned filter configured with a granules group which traps PM.

DPF is characterized by the above-mentioned granules group consisting of the foaming stone grains.

The DPF is characterized by the above-mentioned granules group with an elastic force member which presses the grains in different directions to remove the space between the crevices.

The DPF is characterized by the above-mentioned elastic force member configured from the outer retention cylinder influences the granules group to turn toward the inner retention cylinder with its elasticity force properties.

The DPF is characterized by the above-mentioned elastic force member configured with the filter member which traps PM.

The DPF is characterized by the above-mentioned filter member configured with a combination of carbon fiber felt on the outer side and aluminum continuous fiber cloth membrane on the inner side superimposed together.

The DPF is characterized by the above-mentioned filter member comprising a star-shaped pattern having adjacent mountain-shaped parts and valley-shaped parts which alternately change length radially.

When the DPF exhaust discharged from the diesel engine passes from the exhaust stream entrance part to the inner retention structure filter, the exhaust streams to the outer space. Since PM is a solid type ingredient in exhaust, the PM is adhered and trapped by the filter and prevented from being emitted into the atmosphere. Less the trapped PM. the remaining exhaust ingredients are emitted from the filter to the exhaust stream exit part into the atmosphere.

A while after starting the engine, although the DPF itself along with the exhaust will heat up, the temperature will not reach the PM spontaneous combustion point of about 550 degrees centigrade.

However, if the temperature raises to about 200 degrees centigrade, which is quite lower than the above-mentioned 550 degrees centigrade. the low temperature exothermic catalyst component of precious-metals system will begin to function. HC, etc. in the exhaust will be burned and the exhaust temperature will rise to about 350-400 degrees centigrade.

The catalyst functional range of the exhaust temperature rise by the low-temperature exothermic catalyst of precious-metals system is low. Furthermore, although it cannot be made to go up to the PM spontaneous combustion temperature of about 550 degrees centigrade. in this condition the medium temperature exothermic catalyst of base metals will begin to function at about 300 degrees centigrade. Differing from standard opinion that there is a remote chance of success to produce the above-mentioned reaction between a conventional solid matter catalyst and large solid matter like PM, PM, HC, and CO will burn and render these detrimental ingredients harmless.

Therefore, PM can be removed by combustion even if during the time of a normal run that is somewhat high speed or high intensity and the exhaust temperature is still low, This is the case even when it is not necessary to use a heater to electrically generate heat and $NO_2$ is used as a catalyst Moreover, when suppressing the discharge of $NO_2$, it is possible to cope with this in diesel engines by simply using emulsion fuel with water added to the light oil, which can be easily installed in vehicles.

The DPF consists of a retention structure, outer retention cylinder arranged on the outer side of the inner retention cylinder, which form the inner filter space where the filter and exothermic catalyst are supported in the case cylinder. The exhaust emitted from the diesel engine flows directly to the inner space of the inner retention cylinder and collides with the exhaust plugged part of the outflow side support member. At this juncture, the exhaust stream is redirected to enter the filter space between the inner and outer retention cylinders through the communicative connection passageways of the inner retention cylinder.

Therefore, as exhaust enters the filter space from the large surface area of the inner retention cylinder extended axially, exhaust circulation resistance by suppression is minimized and the possibility of becoming completely clogged by carbon residue is negligible.

Furthermore, when the exhaust flows by the side edge of the exhaust blocking part after colliding and being redirected radially outward, it becomes possible for the temperature to rise in this short time by the side edge, and it becomes possible from the outflow side filter space toward the inflow side filter space to verify conduction of heating and combustion.

Furthermore, when using a granules group as a filter maintenance and replacement can be done efficiently.

As confirmed during testing, since at least one direction of the low temperature exothermic catalyst and medium temperature exothermic catalyst granules groups was made to adhere to the carrier, it is only necessary to have the catalyst material on the surface of the catalyst. Therefore, as only a small quantity of catalyst material is required to cover the larger and more effective surface area, it can be acquired cheaply.

Furthermore, in taking into consideration the granules group, a mixture with another type of catalyst carrier becomes practical and a more synergistic effect can be expected by using both catalysts.

Since at least one direction of the low temperature exothermic catalyst and medium temperature exothermic catalyst was made to adhere to the filter and considering that during testing the other direction of granules group was also made to adhere to the carrier, a filter with two catalyst carriers in the same filter space can be used in a catalyst. It also becomes possible to make the total carrier capacity smaller.

Expensive precious metals, such as platinum, were made to adhere to the catalyst support. The exothermic catalyst of the granules group was made into the low temperature exothermic catalyst as it is possible to maintain a large catalyst surface area while reducing the quantity of precious metals and produce them more cheaply. Also, as the exhaust can easily come in contact with the low temperature exothermic catalyst of precious metals, it becomes possible to efficiently burn HC, etc. at a low temperature.

Furthermore, even if the medium temperature exothermic catalyst of base metals is covered with PM deposits, it is easy to generate heat and burn this carbon soot.

Since the filter is constituted from the granules group which can capture PM and manufactured cheaply, the PM trap surface area can be larger.

Also, even if only one direction of the low temperature exothermic catalyst and medium temperature exothermic catalyst is carried by the filter, mixture with another type of catalyst becomes possible.

Since granules group is constituted from foaming stone grains, it is possible to obtain a filter comprised with a large number of pores and is cheaper to manufacture. Also, this filter can then be used as a catalyst carrier.

The granules group crevices are pressed together by an elastic force member. The low temperature exothermic catalyst and medium temperature exothermic catalyst are densely packed to heighten the synergistic effect of the catalyst.

Additionally, when some of the DPF granular group individual grains are damaged by vibration, etc., the elastic force member prevents further damage by flexibly pressing and removing the crevices between the grains.

Because of the elastic force member in the outer retention cylinder, it becomes possible to markedly reduce its cost reduction and miniaturize its size.

Moreover, since the elastic force member presses the granular group together from the outer retention cylinder toward the inner retention cylinder, the elasticity force helps to maintain its form and structure.

Since the elastic force member of the outer retention cylinder is constituted from the filter member which traps PM, with the filter in the filter space, any residual PM can be trapped at this point and burned.

Moreover, the combination of the outer retention cylinder and the filter member can be considered a compact configuration.

Since the above-mentioned filter member is configured with a carbon fiber felt on the outer side and aluminum continuous fiber cloth filter membrane on the inner side to trap PM, the carbon fiber felt keeps the temperature high and helps burn PM. Also, the elastic force member maintains suitable pressure on the granules group.

Moreover, the aluminum continuous fiber cloth prevents burning of the carbon fiber felt at high temperatures. Conversely, the carbon fiber felt holds both fibers together.

Since the filter member is a star shape, it becomes possible to enlarge the filter surface area with the elastic force member applying pressure on the granules group in conjunction wit the carbon fiber felt. Therefore, it self-maintains its flexibility and shape.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

The present invention will hereinafter be described in detail with reference to the preferred embodiments shown in the accompanying drawings.

Figure 1:
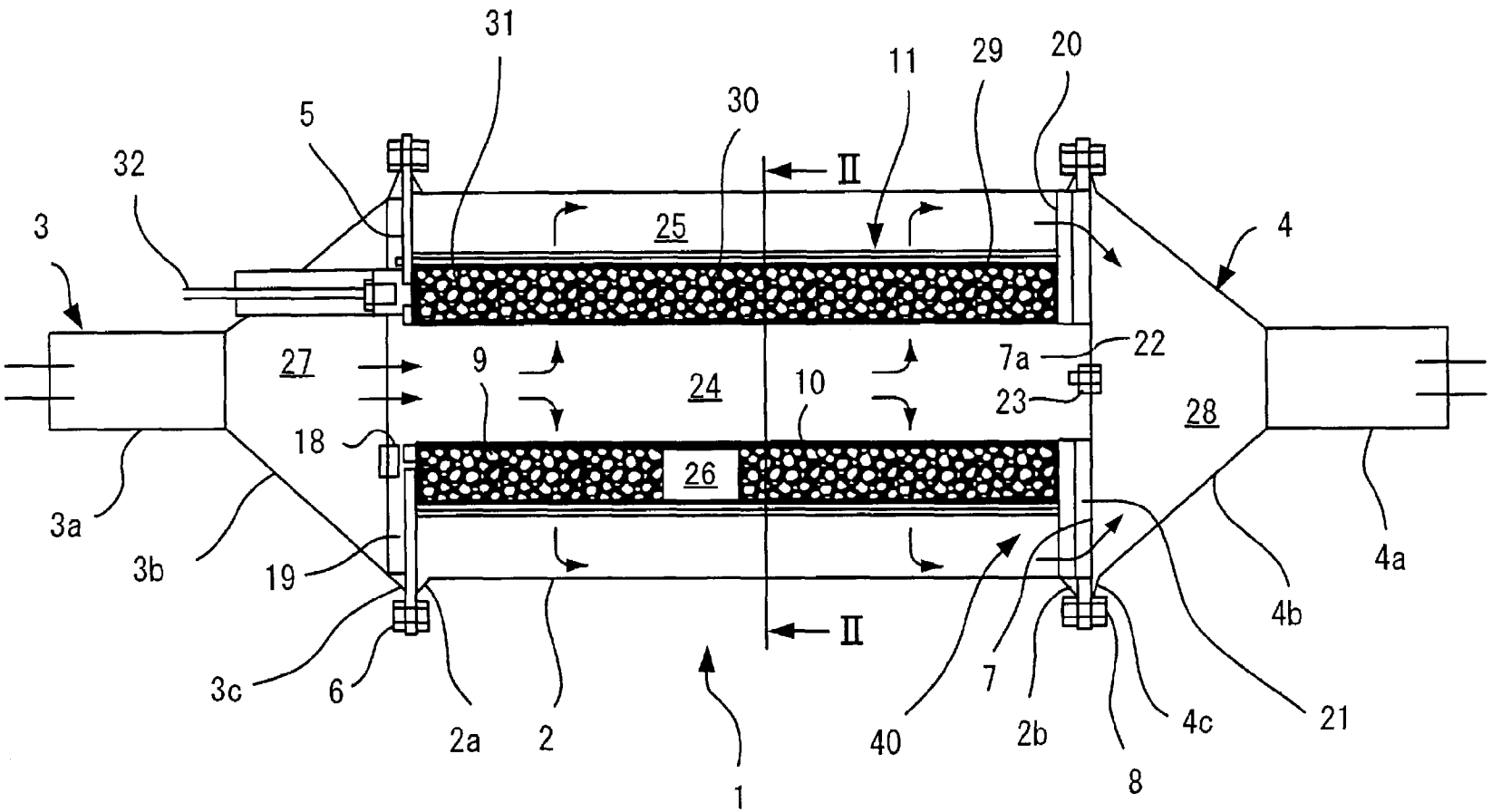
FIG. 1 is an axial sectional view of a diesel engine particulate filter embodying the concept of the present invention.

FIG. 1 is an axial sectional view of a diesel engine particulate filter embodying the concept of the present invention. In FIG. 1, the diesel engine particulate filter 1 formed of stainless steel comprises case cylinder 2, an exhaust stream entrance part 3 attached to the diesel engine side of case cylinder 2, and the exhaust stream exit part 4 is attached to the opposite end side of case cylinder 2.

Exhaust stream entrance part 3 comprises a small diameter exhaust pipe connection segment 3*a* which connects to the exhaust pipe side of a diesel engine, connecting expanded diameter segment 3*b* widens toward case cylinder 2 from exhaust pipe connection segment 3*a*, and flange segment 3*c* constructed with a number of bolt holes spreads radially outward to form the large diameter segment from the direction of connecting expanded diameter segment 3*b*.

The exhaust stream entrance part 3, with flange 3*c* bolt holes aligned to match the annular inflow side support member 5 bolt holes, is fastened to flange segment 2*a* by welding at the periphery of case cylinder 2 and fastened to the case cylinder 2 through bolt and nut 6.

The other end of exhaust pipe connection segment 3*a* is attached to the exhaust pipe side of the engine which is not illustrated, as well as the butted flange parts that connect with bolts and nuts and similarly not illustrated.

Exhaust stream exit part 4 comprises a small diameter exhaust pipe connection segment 4*a* that vents to the atmosphere side and not illustrated, connecting contracted diameter segment 4*b* which narrows toward exhaust pipe connection segment 4*a* from case cylinder 2, and flange segment 4*c* constructed with a number of bolt holes spreads radially outward to form the large diameter segment side from the direction of connecting contracted diameter segment 4*b*.

The exhaust stream exit part 4, with flange 4*c* and disk member 22 bolt holes aligned to match the annular outflow side support member 7 bolt holes, is fastened to flange segment 2*b* by welding to case cylinder 2 and fastened to the case cylinder 2 through bolt and nut 8.

The other end of exhaust pipe connection segment 4*a* is attached to the exhaust pipe side that vents to the atmosphere side which is not illustrated, as well as the butted flange parts that connect with bolts and nuts and similarly not illustrated.

The retention structure 40 is installed inside case cylinder 2. Retention structure 40 as described below consists of the inner retention cylinder 9, outer retention cylinder 11, inflow side support member 5, outflow side support member 7, reinforcement support member 19, intervening member 20, and reinforcement support member 21.

The inner retention cylinder 9 is a reduced diameter virtually arranged on the same concentric axle of the case cylinder 2 and set up so that it is slightly shorter than case cylinder 2. The inner retention cylinder 9 consists of a large number of communicative connection holes and constructed of what is termed punching metal. In other words, the inner retention cylinder 9 consists of the inner space 24 between the inner and outer retention cylinders 9 and 11 to form filter space 26, whereby exhaust flows through a large number of small diameter communicative connection exhaust passage holes in communicative connection part 10.

The radially outward direction of the inner side retention cylinder 9 consists of the inner side retention cylinder 9 and case cylinder 2 which are in essence concentric, and the outer retention cylinder 11 comprises the same axial length at a larger diameter than inner side retention cylinder 9.

Figure 2:
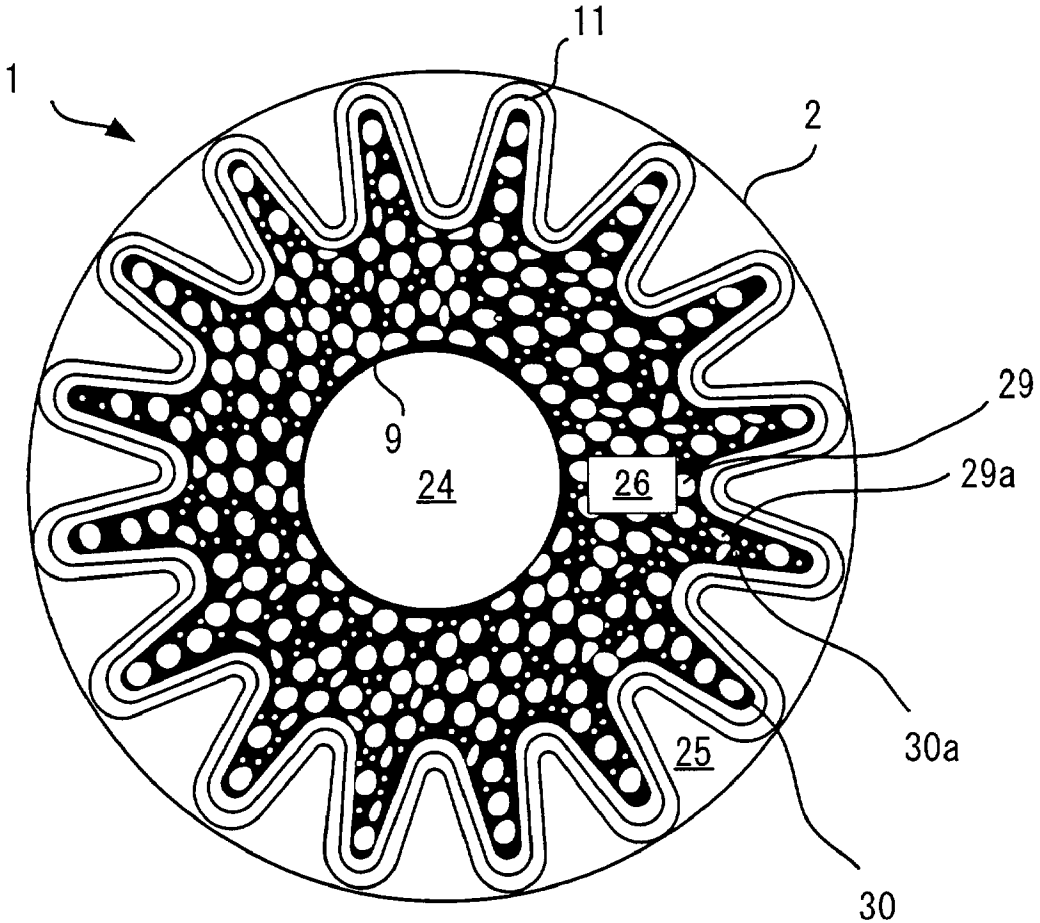
FIG. 2 is a cross-sectional enlarged view of the diesel particulate filter cut along line II of FIG. 1.

The outer retention cylinder 11 enlarged in FIG. 2 shows the large number of mountain-shaped parts 11*a* which extend near the inner periphery of case cylinder 2.

An equally large number of alternate valley-shaped parts 11*b* form adjacent to each of the mountain-shaped parts 11*a* in a star-shaped pattern and extend to their highest position roughly halfway between case cylinder 2 and inner retention cylinder 9. Additionally, mountain-shaped parts 11*a* and valley-shaped parts 11*b* are formed on a curved surface.

Figure 3:
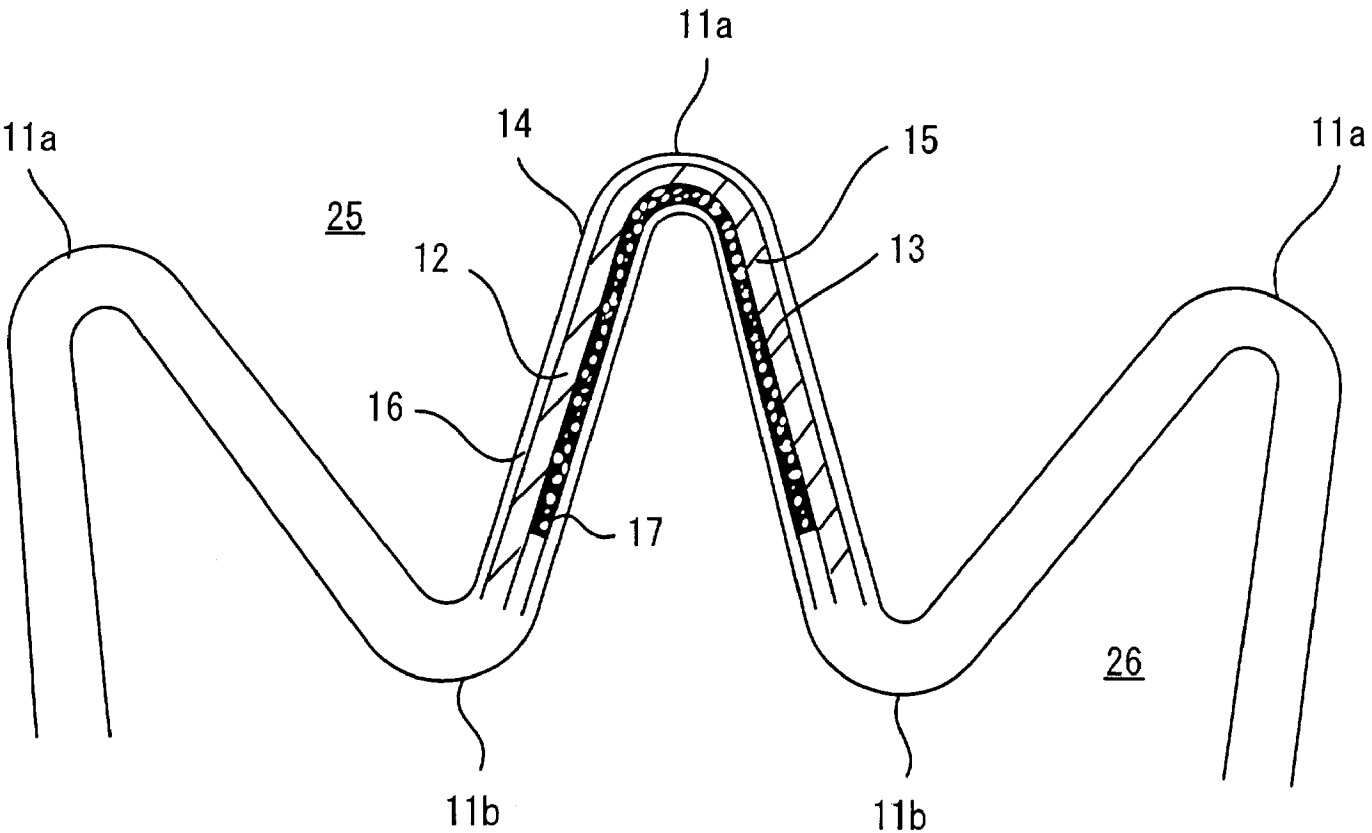
FIG. 3 is a figure an expanded view of the outer retention cylinder part of FIG. 2.

The outer retention cylinder 11, as shown in FIG. 2 and an expanded view in FIG. 3, consists of outer segment of carbon fiber felt 12 and inner segment comprised of aluminum continuous fiber cloth filter membrane 13. These are inserted with lamina 16 and 17 on both the inner and outer sides consisting of thin punching metal comprising a large number of pores and integrally superimposed together as one component.

Additionally, the above-mentioned carbon fiber felt 12 and aluminum continuous fiber cloth filter membrane 13 comprised of aluminum continuous fiber cloth both have microspaces for exhaust to flow from inside filter space 26 to outer space 25, respectively, and constitute the exhaust communicative connection passageways 14 and 15. Carbon fiber felt 12 and aluminum continuous fiber filter membrane 13 control the outward flow of exhaust through communicative connection passageways 14 and 15 set at a dimension to efficiently trap PM.

Furthermore, carbon fiber felt 12 turns outward toward outer retention cylinder 11 inward toward inner retention cylinder 9 and influences operation by its own elasticity force and resiliency.

On the inner retention cylinder 9 and the outer retention cylinder 11 inflow sides, the core of inner retention cylinder 9 outer diameters is fundamentally the same as the inflow side communicative connection 18 formed by the annular inflow side support member 5. On the engine side of inflow side support member 5 of the core of inner retention cylinder 9, the outer diameter is fundamentally formed by the inflow side communicative connection entrance 18 with a thicker annular reinforcement support member 19 attached.

Therefore, when exhaust enters on the inflow side of the communicative connection entrance 18, inflow passes through communication spread diameter 3*b* by way of inner space 27 to inner retention cylinder 9 using inner space 24, as opposed to passing through the inflow side support member 5 and reinforcement member 19 from inner retention cylinder 9 perimeter segment of the inner circumference portion of case cylinder 2. Between these segments, the inflow side exhaust consists of a plugged part which prevents exhaust from flowing in or flowing out.

Moreover, on the inner retention cylinder 9 and outer retention cylinder 11 outflow side, the outer diameter of inner retention cylinder 9's core is fundamentally the same as the inflow side communicative connection entrance 18, respectively, supported by a thicker annular intervening member 20 and reinforcement support member 21 attached to outflow side support member 7.

Also, outflow side support member 7 and disk member 22 are secured with a bolt and nut at the center position.

The above-mentioned outflow side support member 7 comprises the exhaust plugged part through which exhaust cannot flow through into segments inside valley-shaped parts 11*b* of the outer retention cylinder 11. Conversely, from the above-mentioned inner side segment to the outer side segment of intervening member 20, reinforcement support member 21, the segment corresponding to the above-mentioned outer segment of disk member 22 of exhaust stream exit part 4, together with exhaust from the outflow side communicative connection passageways 31 consisting of a large number of communicative connection holes where exhaust formed between outer retention cylinder 11 and case cylinder 2 can flow through to outer space 25 to inner space 28 of exhaust stream exit part 4.

Medium temperature exothermic catalyst carried by granules group 29 comprising a large number of foaming stone group 29*a* consisting of a large number of pores that are inserted in the filter to trap PM in filter space 26 enclosed within the inner maintenance cylinder 9, outer retention cylinder 11, inflow side support member 5 surrounded by outflow side support member 7 (through intervening member 20 and reinforcement support member 21).

The foaming stone group 29*a* use the type of material for instance described in the specification of the present applicant's own application, Japanese laid-open (Kokai) patent application number (A) Heisei 11-126611 (1999) titled "BLACK SMOKE REMOVING DEVICE."

The surfaces of foaming stone group 29*a* are coated with the medium temperature exothermic catalyst component of base metals consisting of nickel or cobalt.

Moreover, inside filter space 26 the above-mentioned foaming stone group 29*a* with a catalyst of base metals are put in to intermingle with a large number of low temperature exothermic catalyst granules group 30 comprised of low temperature exothermic catalyst carried by granules 30*a* of precious metals, such as platinum, with an aluminum oxide ($Al_2O_3$) carrier carried on the inner surface.

Additionally, in inflow side support member 5 and reinforcement support member 19, temperature sensor 32 is inserted into filter space 26 from the inflow side to detect the temperature in filter space 26. Through the harness, which is not illustrated, input from the controller temperature signal can be monitored.

The next section explains the particulate filter operation of the above-mentioned composition.

The exhaust discharged from the diesel engine flows into DPF 1 through the exhaust pipe at engine start. As shown by the arrows in FIG. 1, the exhaust flows inside DPF 1.

Exhaust flows into the inner space 27 of exhaust stream entrance part 3, although its path travels from exhaust pipe connection segment 3*a* to connection expanded diameter part 3*b*, and then virtually unchanged advances straight from inflow side communicative connection 18 to inner space 24 of inner retention cylinder 9.

Although a small portion of the exhaust goes radially outward, the main exhaust portion collides with communicative connection 10 and plugged part 7*a* of outflow side support member 23 with exhaust redirected to filter space 26 radially outward.

In this manner, the exhaust flows radially outward to the inner space 24 and progresses into filter space 26 through communicative connection passageways 10 of inner retention cylinder 9, while striking inner low temperature exothermic catalyst granules group 30 component of precious metals and medium temperature exothermic catalyst carried by granules group 29 component of base metals, flowing radially outward toward outer retention cylinder 11 side.

When the exhaust passes through the inside of filter space 26 just after starting the engine, the temperature of DPF 1 and exhaust is low. Oxidation catalysis by the above-mentioned low temperature exothermic catalyst granules group 30 of precious metals and the medium temperature exothermic catalyst carried by granules group 29 of base metals will not occur in time to burn PM, CO, HC, etc. However, PM is adhered and trapped by foaming stones group 29*a* and accumulated there.

Then, after the DPF 1 and exhaust gradually heat up, HC, etc. begins to burn by means of low temperature exothermic catalyst granules group 30 because of the low temperature exothermic catalyst of precious metals at about 200 degrees centigrade and exhaust temperature will raise to about 350-400 degrees centigrade.

Nevertheless, as the low temperature exothermic catalyst of precious metals has low maximum heat intensity, the temperature rise in the low temperature exothermic catalyst granules group 30 cannot independently reach the level of temperature needed to generate PM spontaneous combustion.

However, when the exhaust temperature raises to about 350-400 degrees centigrade in the low temperature exothermic catalyst granules group 30, because of the low temperature exothermic catalyst of precious metals, PM adhered to stones group 29*a* carrying the medium-temperature exothermic catalyst of base metals which is a solid catalyst. In this case, in spite of scarcely burning at all in the experiment which the inventor mentioned above, it was determined in the research by this inventor that PM begins to burn at about 300 degrees centigrade, which is quite lower than its spontaneous combustion temperature. In addition, HC and CO burn simultaneously at this time.

In general, it is said catalyst and other associated ingredients are solid matter and the regeneration process will hardly progress if the size of the solid particulates will not fit into the catalyst pores (For example, reference publication description on page 15 of Sankyo Publishing Co., Ltd. issue dated Oct. 20, 1997 co-authored by Eiichi Kikuchi, Koichi Segawa, Akio Tada, Yuzo Imizu, Hide Hattori title "New Catalyst Chemistry—$2^{nd}$ Edition").

Apparently HC, etc. begins to burn by means of the low temperature exothermic catalyst granules group 30 if the exhaust gas temperature becomes about 350-400 degree centigrade as it produces oxygen spill over in foaming stones group 29*a* carrying the medium temperature exothermic catalyst of base metals. Because of this result, it is presumed that PM combustion is expedited.

As mentioned above, PM is trapped by foaming stones group 29*a* in filter space 26. The foaming stones group 29*a* carrying the medium temperature exothermic catalyst of base metals and low temperature exothermic catalyst granules group 30 burns the PM and renders it harmless. Detoxified PM together with exhaust are passed through communicative connection passageways 14 and 15 of outer retention cylinder 11, leading to outer space 25 radially outward of outer retention cylinder 11, passing by the outflow side of communicative connection passageways 30 of outflow side support member 7 attached to intervening member 20 and reinforcement support member 21, the connection narrows to exhaust stream exit part 4, and vents from the exhaust pipe into the atmosphere.

In addition, when the above-mentioned exhaust passes outer retention cylinder 11, any residual PM which is not trapped in filter space 26 is captured by carbon fiber felt 12 and aluminum continuous fiber cloth filter membrane 13. Additionally, since the carbon fiber felt 12 retains high temperatures to some extent, it also contributes to the combustion of PM.

Aluminum continuous fiber cloth filter membrane 13, while trapping PM, will prevent carbon fiber felt 12 from becoming damaged by excessively high temperature.

As set forth above, the advantages of the present invention are as follows:

In this practical example, PM contained in the exhaust discharged from a diesel engine adheres to a filter consisting of foaming stones group 29*a* and trapped. If the exhaust temperature becomes about 200 degrees centigrade, HC etc. emissions will be burned by means of the low temperature exothermic catalyst carried by low temperature exothermic catalyst granules group 30 of precious metals, and the exhaust temperature will raise to about 350-400 degrees centigrade.

If the exhaust temperature rises to about 300 degrees centigrade, PM, CO, and HC will be combusted in foaming stone group 29*a* according to the carried base metals in the medium temperature exothermic catalyst and rendered harmless. Thus, it becomes possible to burn PM at a considerably low exhaust temperature, without using an electric heater.

Moreover, by means of both the exothermic catalyst and carried grain support, the catalyst large contact surface area required for catalysis is maintained yet lessens the quantity of precious metals and base metals appreciably. Likewise, in considering the granules group, a mixture of both exothermic catalysts can efficiently be performed.

Furthermore, since outer retention cylinder 11 is composed of carbon fiber felt 12 and aluminum continuous fiber cloth filter membrane 13, it becomes possible to also trap and burn PM carbon residue which by chance escaped filter space 26.

Additionally, considering the carbon fiber felt 12 elasticity force and resiliency properties, the inter-granular crevices between the exothermic catalyst carried by granules group by the side of inner retention cylinder 9 are densely packed. Therefore, even if a portion of the grains are damaged through long term use, the space is filled so if the individual grains should collide, it helps prevent an increasing number of grains from being furthermore damaged.

In addition, you may perform the present invention as follows, without being restricted to the above-mentioned case of the operation.

The low temperature exothermic catalyst and medium temperature exothermic catalyst carried by granules group can be used with another filter, respectively, and carrying the same types of granules.

Likewise, a non-granular filter substrate comprised of a ceramic formed honeycomb-like structure is also acceptable.

In addition, when the above-mentioned circulated exhaust collides with the plugged part 7*a* of outflow side support member 7 formed with tourmaline, a frictional electric charge occurs with the collision of exhaust making it possible to decompose the residual unburnt gas and promote combustion.

Furthermore, in the case where grains are inserted in the filter space replacing carbon fiber felt 12 with an outer retention cylinder consisting of a punching metal piston cylinder, it would be possible to push the piston from the inside with a spring to densely pack the spaces between the inter-granular crevices.

While the present invention has been described with reference to the preferred embodiments, it is our intention that the invention be not limited by any of the details of description thereof.

As this invention may be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

What is claimed is:

1. A diesel engine particulate filter comprising:

a case cylinder connected to a diesel engine via an exhaust pipe having an exhaust stream enhance part and an exhaust stream exit part;

a filter arranged inside said case cylinder for circulating discharged exhaust from said diesel engine and trapping particular matter in said exhaust;

an exothermic catalyst having a low temperature exothermic catalyst of precious metal and a medium temperature exothermic catalyst of a base metal in a state of mixed dispersion thereof on said filter; and a retention structure for retaining said exothermic catalyst and said filter in said case cylinder, wherein said retention structure includes:

an inner retention cylinder which extends along an axis direction of said case cylinder and forms at last one communicative connection passageway enabling outflow of exhaust radially outward; and a star-shaped outer retention cylinder which has alternately a plurality of mountain-shaped parts and a plurality of valley-shaped parts, said star-shaped outer retention cylinder being arranged radially outward of said inner retention cylinder and being formed with micro-spaces to flow the exhaust from an inside thereof to an outside thereof, an inner side and an outer side of said star-shaped outer retention cylinder being shaped like a star and sandwiching a fiber for further trapping residual particulate matter passing through said filter;

wherein the filter with the exothermic catalyst is arranged between said inner retention cylinder and said star-shaped outer retention cylinder, and wherein said low and medium temperature exothermic catalyst coexists on said filter shaped like a star corresponding to said star-shaped outer retention cylinder, being urged toward said inner retention cylinder by elastic force of said fiber of said outer retention cylinder.

2. The diesel engine particulate filter according to claim 1, wherein said retention structure further comprises:

an inflow side support member which supports each inflow side end of said inner retention cylinder and said outer retention cylinder in said case cylinder; and an outflow side support member which supports each outflow side end of said inner retention cylinder and said outer retention cylinder in said case cylinder;

wherein said inflow side support member includes:

an inflow side exhaust blocking section for blocking inflow of exhaust from an outer peripheral part of said inner retention cylinder to an inner periphery part of said case cylinder, and an inflow side interconnecting opening for interconnecting an internal space of said inner retention cylinder and said exhaust stream entrance part and permitting inflow of the exhaust to said internal space of said inner retention cylinder from said exhaust stream entrance part;

wherein said outflow side support member includes:

an outflow side exhaust blocking section for blocking at least outflow of exhaust to said exhaust stream exit part from an inner part of an outer periphery side part of said inner retention cylinder; and an outflow side interconnecting passageway for interconnecting an external space formed between said outer retention cylinder and said case cylinder and said exhaust stream exit part in at least a section between an outer periphery part of said outer retention cylinder and said inner periphery part of said case cylinder; and wherein said filter and said catalyst are retained in a filter space including at an area formed by said valley-shaped pads and said mountain-shaped parts of said outer retention cylinder.

3. The diesel engine particulate filter according to the claim 1, wherein said low-temperature exothermic catalyst and said medium temperature exothermic catalyst are intermingled and density packed to heighten the synergistic effect in said filter as a granule group and to make at least one of these exothermic catalysts adhere to a carrier.

4. The diesel engine particulate filter according to the claim 1, wherein said low-temperature exothermic catalyst and said medium temperature exothermic catalyst are configured by making at least one of said exothermic catalyst adhere to said filter and arranging the other exothermic catalyst around said one exothermic catalyst as a granule group made to adhere to a carrier.

5. The diesel engine particulate filter according to the claim 3, wherein said exothermic catalyst of said granules group is said granule is said low-temperature exothermic catalyst.

6. The diesel engine particulate filter according to the claim 1, wherein said filter is configured with said granule group which can trap said particulate matter.

7. The diesel engine particulate filter according to the claim 3, wherein said granule group is foaming stone grains.

8. The diesel engine particular filter according to the claim 3, wherein said granule group is pressed by said fiber in a direction in which crevices between said granule group are packed.

9. The diesel engine particulate filter according to the claim 8, wherein said star-shaped outer retention cylinder has laminas of punching metal.

10. The diesel engine particulate filter according to the claim 8, wherein said fiber has an aluminum continuous fiber cloth filter membrane.

11. The diesel engine particulate filter according to the claim 8, wherein said fiber has an outer carbon fiber felt and aluminum continuous fiber cloth filter membrane.

12. The diesel engine particulate filter according to the claim 8, wherein said filter member is star-shaped with adjoining valley-shaped parts and mountain-shaped parts which change radial length respectively.

13. The diesel engine particulate filter according to claim 1, wherein the valley-shaped parts extend to a highest position thereof nearly halfway between said case cylinder and inner retention cylinder.

* * * * *